US006095245A

United States Patent [19]

Mount

[11] Patent Number: 6,095,245

[45] Date of Patent: Aug. 1, 2000

[54] WELL PERFORATING AND PACKING APPARATUS AND METHOD

[75] Inventor: Matthew J. Mount, Lafayette, La.

[73] Assignee: Union Oil Company of California, El Segundo, Calif.

[21] Appl. No.: 09/414,094

[22] Filed: Oct. 7, 1999

[51] Int. Cl.[7] ..... E21B 43/04; E21B 43/10

[52] U.S. Cl. ..... 166/276; 166/278; 166/382; 166/387; 166/51; 166/114; 166/116; 166/117; 166/135; 166/185; 166/192

[58] Field of Search ..... 166/51, 55, 55.2, 166/114, 116, 117, 135, 151, 185, 192, 276, 278, 297, 386, 387

[56] References Cited

U.S. PATENT DOCUMENTS

| | | | |
|---|---|---|---|
| 4,401,158 | 8/1983 | Spencer et al. | 166/51 |
| 4,540,051 | 9/1985 | Schmuck et al. | 166/278 |
| 4,541,486 | 9/1985 | Wetzel et al. | 166/297 |
| 4,543,703 | 10/1985 | Wetzel et al. | 29/455 R |
| 4,566,538 | 1/1986 | Peterson | 166/278 |
| 4,655,283 | 4/1987 | Pritchard, Jr. | 166/55.1 |
| 4,878,538 | 11/1989 | Christensen | 166/264 |
| 5,329,998 | 7/1994 | King et al. | 166/51 |
| 5,373,899 | 12/1994 | Doré et al. | 166/278 |
| 5,505,260 | 4/1996 | Andersen et al. | 166/278 |
| 5,865,252 | 2/1999 | van Petegem et al. | 166/297 |
| 5,954,133 | 9/1999 | Ross | 166/297 |

*Primary Examiner*—Roger Schoeppel
*Attorney, Agent, or Firm*—Gregory F. Wirzbicki; William O. Jacobson

[57] ABSTRACT

A repositionable apparatus for perforating and gravel packing an underground well uses gravity or other means to reposition the apparatus instead of a conventional wireline or work string attached to a rig. Perforating and packing can be accomplished without a rig after the apparatus is initially placed and set in the well. One embodiment of the inventive apparatus uses a perforating gun assembly, a connected ported sub above the gun assembly, a translating annulus packer above the ported sub, a circumferential screen located above the packer, blank pipe connected above the screen, an openable port above the blank tubular pipe, and a second translating annulus packer attached to the blank tubular.

24 Claims, 2 Drawing Sheets

WELL PERFORATING AND PACKING APPARATUS AND METHOD

FIELD OF THE INVENTION

This invention relates to underground well devices and processes. More specifically, the invention provides an apparatus and an improved method for perforating and gravel packing a portion of an underground well.

BACKGROUND OF THE INVENTION

Drilling and completing an underground well, e.g., an oil well penetrating an underground formation containing oil or other fluids, sometimes require perforating a portion of a well tubular and a formation followed by gravel packing the well. The perforated tubular and gravel packing allow production of formation fluid while consolidating loose formation materials and helping to prevent formation caving.

Perforating a well is typically accomplished during well completion operations using a conventional perforating gun or similar tool. A plurality of explosive cartridges, shaped charges or other tubular and/or formation penetrating means are used to create holes in the tubular wall and/or formation at a location proximate to a producing zone or other formation of interest.

A fluid or fluid-like substance having a density greater than water is typically used in the wellbore during completion of a well, e.g., a heavy weight drilling mud and water mixture is typically used to create a "kill" fluid. The dense mixture in the wellbore typically produces overbalanced hydrostatic pressures within the wellbore (as compared to nearby formation fluid pressures) that minimize the risk of excessive gas entering the wellbore from a formation.

A viscous entraining fluid or fluid mixture (such as a brine) may also be used during gravel packing operations to entrain gravel particles and carry the stabilizing particles as a slurry into the face of a sandy formation to form the gravel pack. Fluid loss control measures may also be required during a conventional packing process, e.g., using fluid additives to control lost circulation (e.g., LCM "pills") during gravel packing.

Conventional packing processes typically use separate gravel packing tools or other means for placing particulates in the well and/or formation. Gravel packing tools are typically run into the well after the tubulars are perforated and perforation tools have been removed from the well. Backflushing tools for removing excess sand or gravel slurry, coiled tubing, and an associated kick fluid supply (e.g., compressed nitrogen or other gases) may also have to be run into the well after packing in order to clean out viscous fluids and to "kick" or bring a conventionally gravel packed well into fluid production.

Similarly, the conventional process of perforating typically requires separate tools and process steps. Again, removal of dense completion fluids may subsequently be required.

Although some of these process steps are intended to remove potentially damaging fluids and other materials from the well, some portion of these materials tends to remain in the permeable portions of the formation, such as a productive interval. This can damage the productive interval, e.g., by promoting swelling and loss of permeability of a clay-containing formation. Damage to a productive interval may only be shallow (e.g., "skin" damage) and relatively easy to correct, but the damage may also be more extensive and permanent.

In addition to the risk of damage to the formation, significant costs are typically required for a drilling rig or other well intervention unit to be on-site during conventional perforation and packing processes. Rig equipment is typically used periodically throughout both processes, e.g., to supply completion fluids and to support equipment during many "trips" that are required during the processes to place, support, reposition, activate, and/or remove perforating and packing tools.

Although combination perforating and gravel packing tools are known in the art, they also typically require a drilling or workover rig (or other well intervention unit) to be on site and a tubular work string or other apparatus within the well to support the tools in a first position, unsupport the tools, move the tools, and emplace the tools in a second position. The rig and tubular string are also typically used to support and provide completion fluids, slurry, or other fluids to the combination tools.

SUMMARY OF THE INVENTION

The apparatus of the invention allows a well to be perforated and gravel packed and subsequently produced without the need for a drilling rig (after initial placement in a first position) or the need to remove the apparatus from the well. A repositionable perforating and packing assembly or apparatus is placed in a first position within a well using a rig or other spaced-apart supporting means and supported or hung in the well using a releasable hanger. The spaced-apart supporting means can now be removed and the well prepared for fluid production, injection, or other commercial use. When the well is perforated in the first position and the release hanger is actuated, repositioning of the apparatus is accomplished by allowing the apparatus to be essentially unsupported while translating to a second position (instead of using conventional rig-supported wirelines or tubulars to effectuate such movement).

One embodiment of the apparatus of the invention includes serially a release hanger and perforating gun subassembly, a connected ported sub above the gun subassembly, a translating lower annulus packer above the ported sub, a circumferential screen located above the lower annulus packer, a blank tubular or pipe connected above the screen, an openable port above the blank tubular, and an upper translating annulus packer attached to the blank tubular. The two translating annulus packers form an isolated annulus that can be fluidly isolated from the rest of the wellbore, avoiding the need for dense fluid mixtures during perforating or packing steps. If an isolated annulus is not required, at least one of the annulus packers and the openable port can be omitted in an alternative embodiment of the invention.

The process of the invention places the perforating gun subassembly in a first position proximate to a formation of interest, actuates the perforating gun subassembly and releasable hanger using gravity or other means to translate the apparatus within the well tubulars to a second position without the need for a rig or separate tubing string. Once in the second position, a sand, gravel, or other particulate slurry is pumped down past the second annulus packer and diverted through an opened port into the isolated annulus, thus allowing packing to occur. When sufficient particulates are in place, the slurry pumping is terminated, the opened port is restricted, and formation fluid production or other commercial use can commence.

BRIEF DESCRIPTION OF THE DRAWINGS

In these figures, it is to be understood that like reference numerals refer to like elements or features.

DETAILED DESCRIPTION OF THE INVENTION

Figure 1:
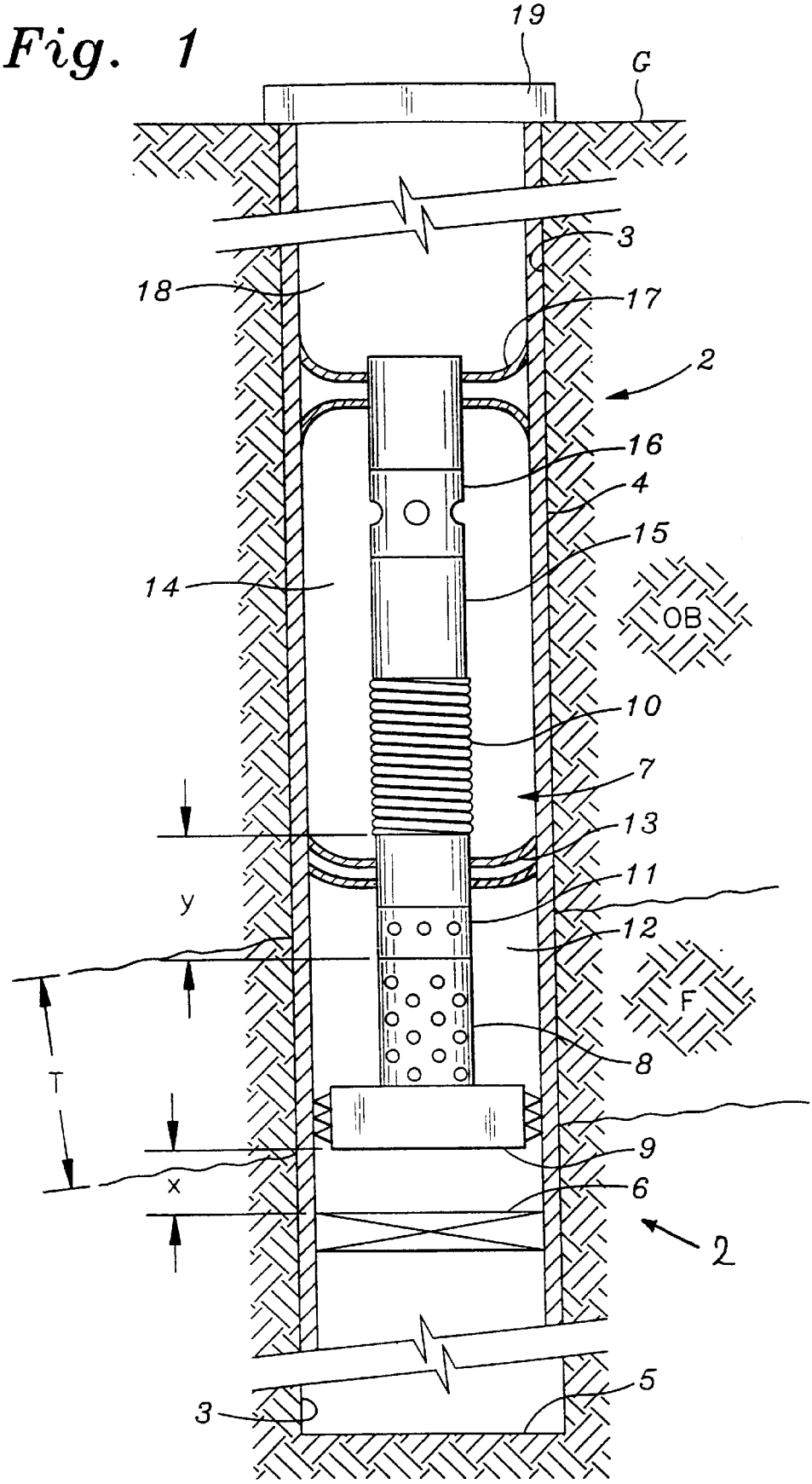
FIG. 1 shows a schematic cross-sectional view of a well after the perforating and packing assembly of the invention is placed in a well in a first position.
Figure 2:
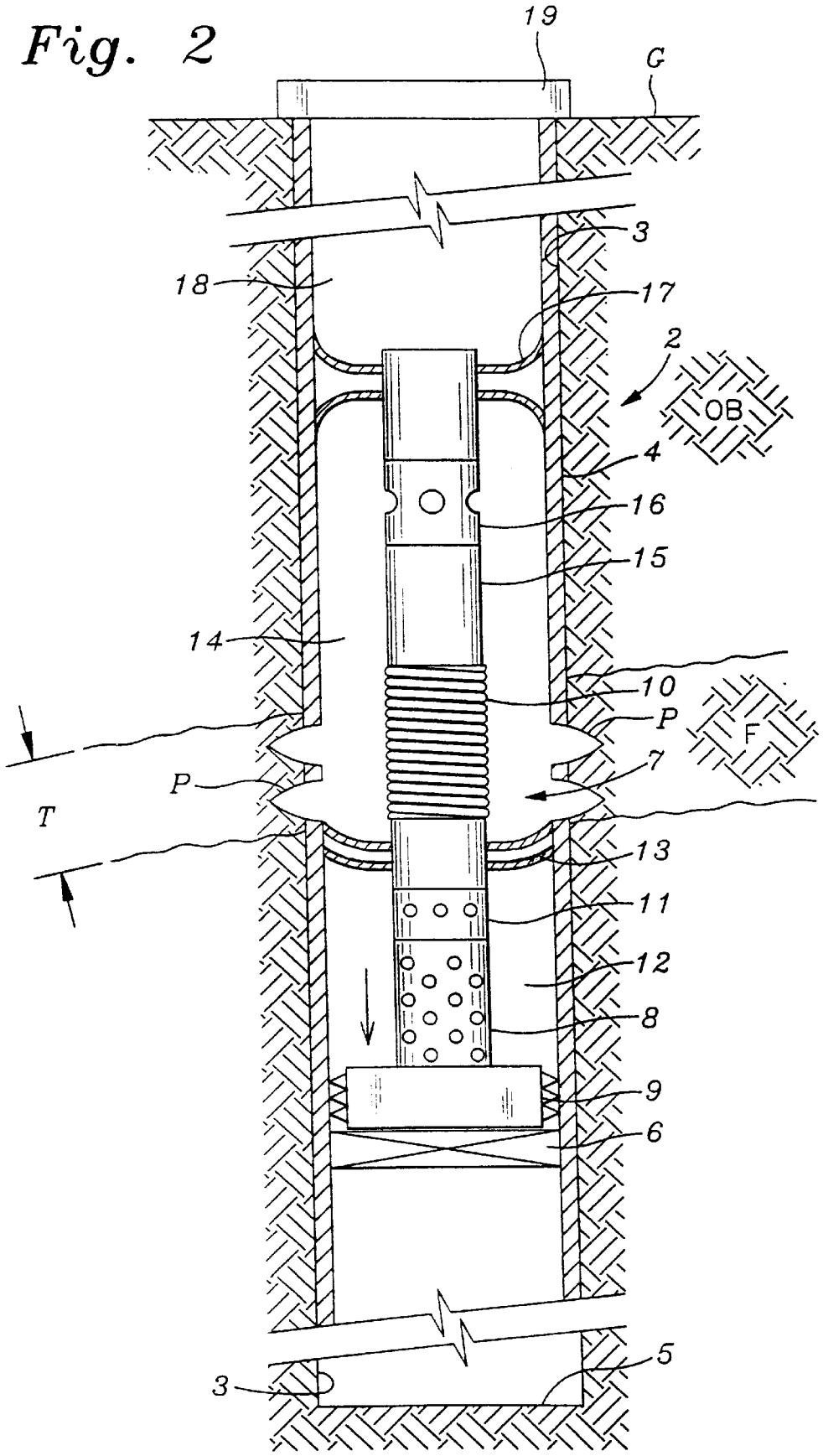
FIG. 2 shows the assembly of FIG. 1 after the assembly is moved to a second position.

FIGS. 1 & 2 show a schematic view of a preferred embodiment of a perforating and packing apparatus or assembly 2 of the invention. In FIG. 1, the apparatus shown is in an initial or first position after being run into a wellbore 3 that penetrates a formation of interest F extending below a non-productive formation or overburden OB. A well casing or other tubular 4 extends within the wellbore 3 from at or near a surface G towards a well bottom 5. Although the embodiment of the invention shown in FIG. 1 is in a casing 4 and wellbore 3 that are nearly vertical and have a constant diameter throughout, in alternative embodiments of the invention, the assembly can be placed in deviated wellbores, wells having progressively smaller diameter casings or liners as depth increases, wells having an open wellbore at the producing zone F, and many other types of underground wells or excavations.

The casing string or other tubular 4 within the wellbore 3 has an axial-flow fluid passageway that extends from near surface G through overburden OB and a formation of interest F towards the bottom 5 of wellbore 3. The tubular 4 preferably comprises joined pipe sections, but may also comprise joined tubing or conductor sections, coiled tubing, or other duct-like elements known to those skilled in the art. The joined pipe sections can be directly attached to each other by welding, rotating mating threads at each end, or other joining means known to those skilled in the art, such as end fittings or couplings.

The perforating and packing assembly 2 consists of a sump packer or other passageway stop or plug 6 and a repositionable or drop assembly 7. The top of sump packer 6 is placed in the wellbore 3 at an approximate distance x below the lower boundary of the formation of interest F. The sump packer 6 is preferably a model 'N' wireline set bridge plug available from the Baker Oil Tool Company having an office located in Lafayette, La. After placement in the wellbore 3, the sump packer 6 must be securely attached to the wellbore such that the drop assembly 7 is supported and prevented from further substantial downward movement after contacting the sump packer. Alternatively, other packers, plugs, or well obstructions may be used in place of the sump packer 6. In addition, the well bottom 5 may also be used as a stop if it is appropriately located.

The bottom of drop assembly 7 is placed in the wellbore 3 at an approximate distance x from the sump packer 6. The placement essentially locates a perforating gun subassembly or other perforating means portion 8 of the drop assembly 7 proximate to the formation of interest F. Although the drop assembly 7 can be placed in position and supported using tubing, a work string, a wireline, or other means, the drop assembly is preferably only supported after being positioned in the well by an auto release gun hanger or other releasable support 9 set to hold the drop assembly in place until the perforating gun subassembly has been signaled to discharge. Alternatively, inflatable packers or other means can be used for setting and releasing the drop assembly 7, the release allowing the drop assembly to slide or be moved down the tubular 4 while being essentially unsupported until the drop assembly reaches the sump packer 6.

Distance x can vary significantly, but is typically dependant on the dimensions of the drop assembly 7, specifically, the distance y between the top of a perforating gun subassembly or other perforating means 8 and the bottom of a screen 10 as well as the length of the perforating means. Distance x is usually in the range of about 20 to 200 feet, more typically about 20 to 100 feet. Distance y is usually less than distance x, preferably ranging from about 10 to 30 feet.

The perforating gun subassembly 8 is preferably a tubing-conveyed model available from the Baker Oil Tool Company having an office located in Lafayette, La. Besides cartridges similar to bullets, the perforating subassembly 8 may alternatively use shaped charges, mechanical penetrators, or other means for penetrating the tubular 4 and/or wellbore 3. The size and configuration of the perforating gun subassembly 8 are dependent on many factors including the thickness T of the formation of interest F, the porosity and other properties of formation F, the thickness and properties of tubular 4, the properties of the gravel or proppant used, and the type of completion desired.

The perforating gun subassembly 8 is preferably attached directly above (as shown in FIG. 1) or directly below the auto release gun hanger 9. In alternative embodiments, the auto release gun hanger 9 can also be spaced apart from the perforating gun subassembly 8, e.g., a releasable support can be located at the top of the drop assembly 7. In still other embodiments, an alternative drop assembly can be hung from a wireline or work string and thereafter separated from the wireline or work string concurrent with or after perforating the wellbore 3 and/or tubular 4.

An optional ported sub or ported subassembly or other restrictable port device 11 is preferably attached to the top of the perforating gun subassembly 8. When open, the ported sub 11 allows an essentially radial fluid flow through a restrictable port or passageway between the interior of the drop assembly 7 and a lower annulus 12 located between the lower portion of the drop subassembly and the tubular 4 and/or wellbore 3. In addition to allowing fluid flow, the ported sub 11 allows pressure equalization between the lower annulus 12 and the interior of the drop assembly 7. Other embodiments of the invention may omit the ported sub 11, include fixed restriction ports instead of a ported sub 11 or use openings created by an alternative perforating gun subassembly.

A lower isolation packer or other translatable annulus restrictor 13 is preferably attached to the top of the ported sub 11. The lower isolation packer 13 separates the lower annulus 12 from the upper annulus 14 located between the upper portion of the drop assembly 7 and the wellbore 3 and/or tubular 4. The lower isolation packer 13 preferably includes two upward-facing cup-like packers for more securely restricting fluid or slurry flow and for more reliably supporting solid particles in the upper annulus 14 while at the same time allowing the drop assembly 7 to move within the wellbore 3. A preferred lower isolation packer 13 is based on a model 'E' Circulating Wash Tool available from Baker Oil Tool Company having an office located in Lafayette, La. and modified as shown in FIG. 1. Alternative embodiments of the invention can include an inflatable packer (deflating to allow translation or dropping within the wellbore 3), a slidable plug, a cement basket properly sized to slide within the tubular 4, or a similar device restricting axial fluid flow from or to upper annulus 14.

In still another embodiment, an alternative auto release gun hanger may function as a combined hanger and packer or other fluid restrictor. The combined hanger and packer would restrict axial fluid flow from and to upper annulus 14 so that a separate lower annulus packer 13 is not needed.

A screen and/or screen holder or other particulate filtering means 10 is preferably attached to the top of the lower isolation packer 13. The screen 10 is preferably a stainless steel, wire-wound screen similar in design and construction to conventional screen systems used in conventional packing operations. Instead of the screen 10, alternative embodiments of the invention may include a slotted liner, wire mesh type screens, pre-pack screens or sintered metal systems.

A blank pipe section or tubular member 15 is preferably attached to the top of the screen or screen holder 10. The blank pipe section 15 typically has a diameter comparable to the screen holder and/or screen 10 and has a length that allows an amount of gravel to accumulate in the upper annulus 14 sufficient to mostly fill the lower portion of upper annulus 14. Typically, the length ranges from about 10 to 100 feet, but may range as high as 200 feet or more.

A sliding sleeve assembly or restrictable radial-flow port device 16 is preferably attached to the top of the blank pipe section 15. One embodiment of the invention uses a model 'CMU' sliding sleeve that can be obtained from the Baker Oil Tool Company having an office located in Lafayette, La. Alternatively, devices such as a valve or other restricted port element, a flow diverter, or a rupture disk may be used in place of a sliding sleeve assembly 16.

An upper isolation packer or annulus restrictor 17 is attached to the top of the sliding sleeve assembly 16. The preferred upper isolation packer comprises two cup packer elements, one facing up and the other facing down, isolating the upper annulus 14 from the upper interior space 18 of the wellbore 3 and restricting fluid flow in either direction within the wellbore. A preferred upper isolation packer 17 is based on a modified model 'E' Circulation Wash Tool that can be obtained from the Baker Oil Tool Company having an office located in Lafayette, La. Alternatively, devices such as a plug, inflatable packer, and mechanical or hydraulic set packers may be used in place of an upper isolation packer 17.

If an isolatable upper annulus is not required for an application (e.g., to allow a less dense completion fluid to be used), the sliding sleeve 16 and upper isolation packer 17 become optional. A frangible or otherwise removeable assembly plug can be used in place of the sliding sleeve assembly 16 to prevent particles from entering the interior of screen 10, but the assembly plug may also be omitted for example if unwanted particulates are flushed out or otherwise removed prior to production.

Well equipment 19 is used to drill, complete, and commercially use the well. Conventional well equipment can include a rig, signaling equipment, pumps, blowout prevention equipment (BOPE), piping to allow the flow of formation or other fluids and other equipment used to support underground equipment and sustain drilling, completion, and fluid production from the well. In preparing a well for production, the drop assembly 7 is preferably set prior to actuating the perforating guns. The production tubulars and related equipment are then run into the well, BOPE is removed, and a production tree installed at or near the surface G. The rig is no longer required to complete the well and can be removed at this time. Use of the apparatus of the invention enables the perforating and gravel packing to be carried out in the absence of a drilling or workover rig.

Use of the perforating and packing apparatus 2 allows nearly simultaneous perforating and packing of a well, followed soon after by formation fluid production or other commercial use of the well. The signal to actuate the perforating gun subassembly 8 may also be used to simultaneously actuate and release the auto release gun hanger 9. After release, the drop assembly 7 slides or otherwise moves downward from the position shown in FIG. 1 to the position shown in FIG. 2. Motion of the drop assembly 7 is preferably the result of gravity acting on the unsupported assembly, but translation may also be the result of fluid pressure differential across one or more packers, mechanical actuators or other means. The essentially simultaneous perforation and relocation of the drop assembly 7 allows a gravel packing process to proceed without significant delay or work string support. The configuration of the drop assembly 7 also allows formation fluids to be produced or other commercial use of the well after the gravel packing process without the need for removing the drop assembly.

A preferred process of using the perforating and packing apparatus 2 is to position the sump packer 6 at a depth x below the bottom of formation F or the to-be-perforated zone within the wellbore 3 as shown in FIG. 1. Depth x is selected to allow the drop assembly 7 to be supported by the sump packer 6 after the drop assembly is dropped from its initial position. The remotely actuated auto release gun hanger 9 is used to initially position the drop assembly 7 so that the perforating gun subassembly 8 is supported within the wellbore 3 proximate to a portion of formation F and approximately spaced apart a distance X from the sump packer 6. Actuation of the perforating guns creates perforations P and remote actuation may be accomplished by pressure pulse, electric signals, wire line, or time delay device. The actuation signal may also simultaneously actuate the release of the auto release hanger 9 and allow the drop assembly to drop onto the sump packer 6. Alternatively, separate signals may be used to actuate the perforating gun and gun hanger release.

After the drop assembly 7 has dropped onto the sump packer 6 as shown in FIG. 2, stimulation and/or packing fluid mixtures are pumped through the production support equipment 19, down the tubular 4, and forced into the top and interior of the drop assembly 7 by the upward facing cups of the upper isolation packer 17. The fluid is then forced outward through the open ports of the sliding sleeve 16 into the upper annulus 14, down the upper annulus 14, and into the perforations P leading to formation F. The fluids are preferably forced out of the open ports on the sliding sleeve 16 by a restrictor or other restricting means within the sliding sleeve or drop assembly 7. If optional upper isolation packer 17 and sliding sleeve assembly 16 are not included in an embodiment of the invention, the fluid mixture may be diverted out of an alternative drop assembly by an assembly plug that is removed prior to formation fluid production.

Gravel packing completions are only one of many types of well and/or well completion applications that can benefit from the use of the drop assembly 7 or similar apparatus. Other applications that may find the drop assembly 7 or similar apparatus of benefit include stimulating open hole completions using a proppant, frac-pack completions, water packed completions, and extreme overbalance completions.

Because the tubular or casing string 4 and the perforating and packing apparatus 2 handle a gravel or sand slurry during the gravel packing process, tubulars and other equipment should be erosion resistant. Hence, pipe sections should be composed of hardened materials and sharp corners or bends should be avoided. In addition, gap fillers can be used at connectors, and tubular diameters and fluid handling components selected to avoid excessive slurry velocities. Depending upon the production fluids that the tubulars must also handle, the apparatus 2 and tubing string 4 may also have to be corrosion resistant and allow reservoir fluids to flow to the surface "G" without excessive pressure loss or slippage.

Although not shown, a production tubular (within the tubular 4) may extend from at or near surface G towards the first position of drop assembly 7 shown in FIG. 1. The production tubular may be used to carry produced formation fluids to the surface. Although having a diameter smaller than the casing or tubular 4, the production tubular differs from a drill or work string in several respects. The wall thickness of a production tubular is usually thinner than a work string since the pressure rating of a work string can be up to about 30,000 psi or higher, whereas a production tubing string pressure rating typically is less than about 20,000 psi.

The upper isolation packer 17 and the sump packer 6 isolate a portion of wellbore 3 proximate to the formation of interest F from the rest of the wellbore. The combination of sump, upper and lower packers allows a less dense or different fluid to be introduced into the lower annular space 12 separate from fluids in the upper annular space 14 or any fluids below the sump packer 6. This allows lighter or less dense completion fluids to be used, avoiding the conventional process steps of backflushing and/or kicking or otherwise using compressed gas to bring a well into commercial fluid production.

The gravel packing and stimulation of the formation F is designed so that a set amount of slurry is placed outside the perforated tubular 4 and the slurried proppant or other particulates are allowed to begin filling the annulus space between the drop assembly 7 and the casing 4. As the proppant fills the annulus around the blank pipe 15, a differential pressure will develop between the top and bottom of a shear-pinned plug located inside the sliding sleeve. When the differential pressure exceeds the shear pin rating, the pins shear and the sliding sleeve closes the ports, thereby isolating the inside and outside of the sliding sleeve assembly 16. Additional pressure then forces the internal plug to the bottom of the drop assembly 7 essentially out of the internal flow path. With the internal plug removed from the flow path within the sliding sleeve assembly 16, the formation fluids can flow from formation F through the perforations and the screen 10 up towards the surface G. The upper and lower isolation packers 17 & 13 combined with the screen 10 prevent the gravel or proppant from flowing out of the well as formation fluids are being produced. Fluid production, injection or other commercial use of the well can begin and continue without the need to remove the drop assembly 7.

Still other alternative embodiments are possible. These include: a plurality of spaced-apart perforating gun subassemblies to perforate several zones or formations of interest, e.g., having two perforating gun assemblies that are proximate to two formation layers separated by a water-containing clay layer when a alternative drop assembly is in a first position; additional packers to further isolate portions of the wellbore, e.g., separating annulus zones proximate to several oil-producing formation layers from water producing layers; additional screens and/or restrictable ports on an alternative drop assembly, e.g., separate screens within each packer-separated annulus zone; a tubular member that incorporates radial flow ports and a radial-flow screen instead of directly or indirectly connected components, and the use of a separable perforating gun or other subassembly instead of the perforating gun subassembly connected to a tubular member.

Although the preferred embodiment of the invention has been shown and described, and some alternative embodiments also shown and/or described, changes and modifications may be made thereto without departing from the invention. Accordingly, it is intended to embrace within the invention all such changes, modifications, and alternative embodiments as fall within the spirit and scope of the appended claims.

What is claimed is:

1. An apparatus for perforating and packing a portion of an underground well proximate to a formation of interest, wherein fluid from said well can be produced without removal of said apparatus from said well, said apparatus comprising:

(a) a repositionable assembly comprising (1) a releasable support for supporting the repositionable assembly in a first position within said well, (2) a perforating subassembly directly or indirectly connected to said releasable support, (3) a tubular member directly or indirectly connected to said releasable support, (4) a substantially radial-flow screen directly or indirectly connected to said tubular member, (5) a restrictable radial-flow port device directly or indirectly connected to said tubular member, and a translatable annulus restrictor directly or indirectly connected to said tubular member; and (b) a stop attachable to said well at a position below said repositionable assembly wherein said stop is capable of supporting and stopping the downward movement of said repositionable assembly at a second position within said well after said releasable support releases said repositionable assembly from said first position, wherein essentially only fluid pressure and the forces of gravity provide the motive force to move said repositionable assembly.

2. The apparatus of claim 1 wherein said releasable support comprises an auto release gun hanger.

3. The apparatus of claim 2 wherein said stop is a plug.

4. The apparatus of claim 3 where said plug comprises a sump packer.

5. The apparatus of claim 4 wherein said perforating subassembly is a tubing conveyed perforating gun assembly.

6. The apparatus of claim 5 wherein said translatable annulus restrictor comprises a cup packer.

7. The apparatus of claim 6 wherein said translatable annulus restrictor comprises at least two cup packers.

8. The apparatus of claim 7 wherein at least two of said cup packers are spaced apart from each other.

9. The apparatus of claim 8 wherein said repositionable assembly is capable of being moved from said first position to said second position by essentially only the force of gravity.

10. The apparatus of claim 9 wherein said repositionable assembly is capable of being moved from said first position to said second position in the absence of a well intervention unit.

11. The apparatus of claim 10 wherein the distance between said first and second positions is in the range of 10 to 200 feet.

12. The apparatus of claim 11 wherein said restrictable radial-flow port device is restricted in said second position.

13. The apparatus of claim 12 wherein said restrictable radial-flow port device comprises a ported subassembly.

14. An apparatus for perforating and packing a portion of an underground wellbore proximate to a formation of interest, wherein said wellbore can be used commercially without removal of said apparatus from said wellbore, said apparatus comprising:

(a) a repositionable assembly comprising a releasable support for supporting the repositionable assembly in a first position within said wellbore, a perforating subassembly directly or indirectly connected to said releasable support, and a substantially radial-flow screen directly or indirectly connected to said perforating subassembly; and (b) means for stopping the downward fall of said repositionable assembly at a second position within said wellbore after said releasable support releases said repositionable assembly from said first position.

15. The apparatus of claim 14 wherein said means for stopping is a stop attached to said wellbore.

16. The apparatus of claim 15 wherein said stop is a sump packer.

17. An apparatus for perforating and packing an underground wellbore comprising:

(a) a stop attached to said wellbore; and (b) a repositionable assembly supportable by said stop when in said wellbore, wherein said repositionable assembly comprises:

a means for releasably supporting the repositionable assembly in a first position spaced apart from said stop within said wellbore;

a means for perforating said wellbore, said means for perforating directly or indirectly connected to said means for releasably supporting;

a means for radially screening fluid flow directly or indirectly connected to said means for perforating;

a means for restrictably controlling radial fluid flow connected to said means for screening; and a means for annularly sealing said repositionable assembly capable of allowing said repositionable assembly to move downwards in the absence of a well intervention unit after said means for releasably supporting releases said repositionable assembly from said first position.

18. The apparatus of claim 17 wherein said means for releasably supporting comprises an auto release gun hanger, said means for perforating comprises a perforating gun subassembly, said means for screening comprises a helical screen, said means for restrictably controlling fluid flow comprises a ported subassembly, and said means for annularly sealing comprises a plurality of cup seals.

19. An repositionable assembly apparatus for perforating and packing an underground wellbore comprising:

a means for releasably supporting said repositionable assembly in a first position spaced-apart from the bottom of said wellbore;

a means for perforating said wellbore, said means for perforating directly or indirectly connected to said means for releasably supporting; and a means for radially screening fluid flow directly or indirectly connected to said means for perforating, wherein said repositionable assembly is capable of moving downwards to a second position within said wellbore in the absence of a well intervention unit after said means for releasably supporting releases said repositionable assembly from said first position.

20. The apparatus of claim 19 which also comprises a removeable axial fluid-flow plug connected to said means for radially screening fluid flow.

21. A process for perforating and gravel packing an underground wellbore comprising:

(a) placing a plug inside said wellbore using a well intervention unit;

(b) placing within said wellbore a repositionable perforating and packing assembly in a first position spaced apart from said plug, wherein said repositionable assembly comprises a releasable hanger and a perforating subassembly;

(c) hanging said repositionable perforating and packing assembly such that it is essentially fully supported by said releasable hanger generally in said first position and essentially unsupported by said well intervention unit;

(d) actuating said repositionable perforating and packing assembly to perforate said wellbore and to release said releasable hanger such that the released repositionable assembly moves down said wellbore until said repositionable assembly rests on said plug; and (e) packing said wellbore.

22. The process of claim 21 which also comprises the step of (f) producing formation fluids.

23. The process of claim 22 wherein said actuating step simultaneously releases said releasable hanger and perforates said wellbore.

24. The process of claim 23 wherein said well intervention unit comprises a drilling rig.

* * * * *